United States Patent [19]

Janhonen

[11] Patent Number: 4,956,961

[45] Date of Patent: Sep. 18, 1990

[54] APPARATUS FOR WRAPPING AND CLOSING A BOOK PACKAGE

[75] Inventor: Veikko I. Janhonen, Jorvas, Finland

[73] Assignee: Pussikeskus Oy, Helsinki, Finland

[21] Appl. No.: 351,872

[22] Filed: May 12, 1989

[30] Foreign Application Priority Data

May 19, 1988 [FI] Finland ..... 882347

[51] Int. Cl.[5] ..... B65B 11/02; B65B 13/22

[52] U.S. Cl. ..... 53/176; 53/590

[58] Field of Search ..... 53/176, 218, 219, 399, 53/589, 590, 528, 526

[56] References Cited

U.S. PATENT DOCUMENTS

| | | | |
|---|---|---|---|
| 2,050,715 | 8/1936 | Malocsay | 53/176 |
| 2,908,121 | 10/1959 | Enos | 53/399 |
| 2,937,484 | 5/1960 | Wiman | 53/176 X |
| 3,327,452 | 6/1967 | Cranston et al. | 53/218 |
| 3,698,152 | 10/1972 | Reed | 53/176 X |
| 3,886,026 | 5/1975 | Kienel | 53/590 X |
| 4,408,438 | 10/1983 | Rewitzer | 53/399 X |
| 4,625,635 | 12/1986 | Lewis | 53/589 X |
| 4,627,218 | 12/1986 | Akerström et al. | 53/399 |
| 4,627,223 | 12/1986 | Janhonen | 53/399 X |
| 4,757,666 | 7/1988 | Janhonen | 53/218 X |

*Primary Examiner*—Robert L. Spruill
*Assistant Examiner*—Linda B. Johnson
*Attorney, Agent, or Firm*—Price, Heneveld, Cooper, DeWitt & Litton

[57] ABSTRACT

The invention relates to an apparatus for wrapping and closing a book package. On either side of the plane of a strapping frame (4) in an automatic strapping machine (1) are provided folding means (7) for a cardboard package blank (5) as well as vertically movable press members (10) for holding a book package (6) stationary during the folding of cardboard (5) and for pressing and holding the folded cardboard against the top surface of a book package at the same time as the strapping machine winds a strapping band around said package (5, 6).

4 Claims, 2 Drawing Sheets

APPARATUS FOR WRAPPING AND CLOSING A BOOK PACKAGE

The present invention relates to an apparatus for wrapping and closing a book package, said apparatus comprising an automatic strapping machine provided with a storage drum for strapping band as well as a strapping frame provided with an opening for placing a package to be closed on top of the strapping machine table.

Strapping machines are used for winding a strapping band around an otherwise finished package, such as a cardboard box. On the other hand, e.g. the Applicant's U.S. Pat. No. 4 627 223 discloses a packaging blank, wherein a rectangular sheet of cardboard is not folded around a package until a bundle of books is enclosed in the package. The manual folding of a sheet of cardboard in such a packaging blank is inconvenient and tedious and stresses the hands of a packer, particularly the wrists get sore. For this reason, the Applicant has already proposed (U.S. Pat. No. 4 757 666) an automatically operated mechanical apparatus for effecting the folding of a cardboard packaging blank around a package or a parcel. This machine has proved highly useful and it has made the packing of books considerably quicker and easier. For example, so-called readers' clubs are mailing large amounts of book parcels to individual receivers. For this purpose, the package has been carried on a conveyor from a cardboard folding machine to a separate strapping machine. This type of arrangement is applicable for obtaining a high output, whereby several persons are supplying wrapping blanks along with book packages onto a conveyor for carrying the blanks to a cardboard folding machine.

However, all applications do not require such a high output that it would be economically sound to acquire two separate machines, one for cardboard folding and the other for strapping a band.

An object of the invention is to combine a cardboard folding apparatus with a prior known strapping machine for providing at lower cost an apparatus serving a lower packaging capacity, said apparatus effecting both cardboard folding and strapping of a band around a finished package. Since both operations are performed at the same working station, the use of an adhesive can be completely eliminated for closing a package as temporary closing is not necessary between a cardboard folding machine and a band strapping machine.

This object is achieved by means of the invention on the basis of the characterizing features set forth in the annexed claims.

One embodiment of the invention will now be described in more detail with reference made to the accompanying drawings, in which FIG. 1 is a front view of an apparatus according to one embodiment of the invention and FIG. 2 shows the apparatus of FIG. 1 in a side view.

Figure 1:
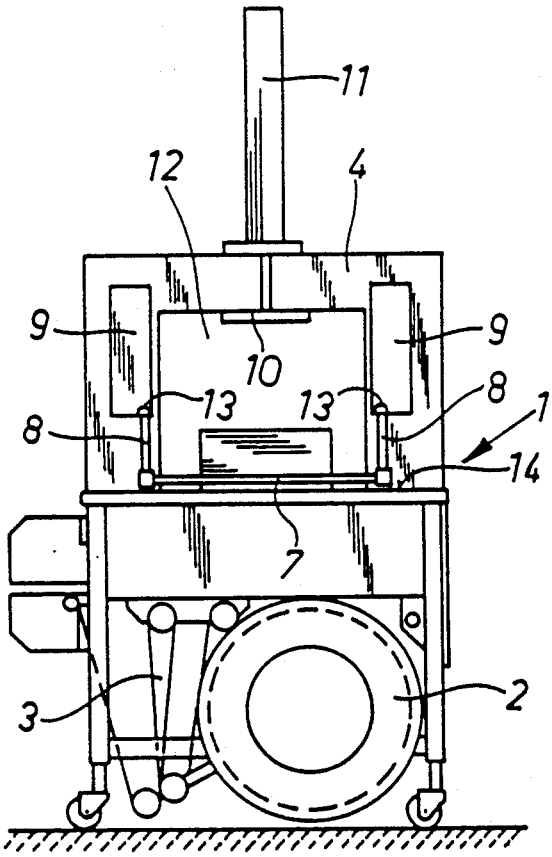
Figure 2:
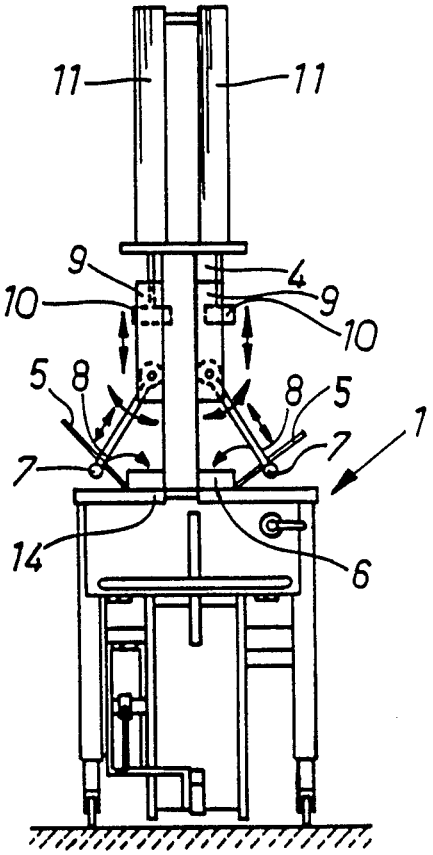
Figure 3:
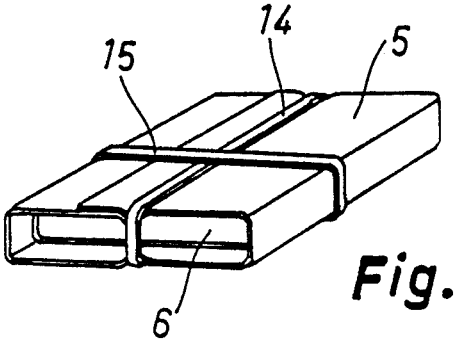
FIG. 3 shows a finished book package produced by the apparatus.

In FIGS. 1 and 2, reference numeral 1 designates a basically conventional, commercially available strapping machine, comprising a storage drum 2 for a strapping band 3 as well as a strapping frame 4, said machine 1 strapping a band around a package placed in its opening 12 on a table 14. Therefore, the side 1*a* of strapping frame 4 facing said opening 12 as well as the table 14 are provided with a gap through which a strapping band extending around the package can be pulled.

In the invention, however, the question is about a packaging blank that is not a finished package but, instead, a sheet of cardboard 5 must be first folded around a book or a bundle of books 6. As described in the cited U.S. Pat. No. 4 627 223, a book or a bundle of books 6 has been first enclosed in a paper wrapper or a plastic film which is fastened in the middle to a sheet of cardboard 5.

Folding means 7 for a sheet of cardboard 5 consists of bars or tubes, secured at their ends to lever arms 8 the upper ends of which are secured in a housing 9. The housing 9 is provided with piston-cylinder devices (not shown) for moving the upper ends of lever arms 8 in a vertical direction. Since lever arms 8 are guided in apertures 13 at the bottom end of housing 9, their vertical movement causes the swinging of lever arms 8 to also pivot in a horizontal direction. If necessary, the guide aperture 13 for lever arms 8 can be adapted to be movable also in horizontal direction, whereby the swinging or pivoting movement of lever arms 8 is at least partially independent of their vertical movement. Thus, the folding means 7 can be given a desired trajectory, e.g. as indicated with arrows in FIG. 2.

The strapping frame 4 is fitted with vertical piston-cylinder units 11, the bottom ends of the piston rods of which carry pressing members 10 which can be brought to bear against the top surface of a bundle of books 6 during the folding of cardboard 5. The pressing members 10 prevent a bundle of books 6 from being lifted up when the ends of the cardboard 5 are being folded from their horizontal position to a vertical position. When the ends of cardboard 5 have reached vertical, said press members 10 can be raised and the final folding of cardboard 5 can be effected. The movement of the folding means 7 must be controlled in a manner such that one of them performs its folding action slightly ahead the other, so that the ends of cardboard 5 do not bump into each other but settle on top of each other in an overlapping fashion.

As soon as the ends of cardboard 5 are folded, said folding means 7 are moved aside and press members 10 are urged down for pressing and holding the ends of folded cardboard 5 against the top surface of bundle of books 6 while said strapping machine 1 runs a band 14 around a package 5, 6. If necessary, this can be followed by turning the package through 90° and by having said strapping machine 1 perform a second strapping action for winding a crosswise band 15 around the package. Thus, the integrity of a package has been secured also without the application of an adhesive. However, it is possible to have applied some self-adhesive glue to the facing end surfaces of cardboard 5.

In the case shown in FIGS. 1 and 2, the folding plane of cardboard 5 is perpendicular to the plane of strapping frame 4, whereby the horizontal movement component of folding means 7 is also perpendicular to the plane of strapping frame 4.

Figure 4:
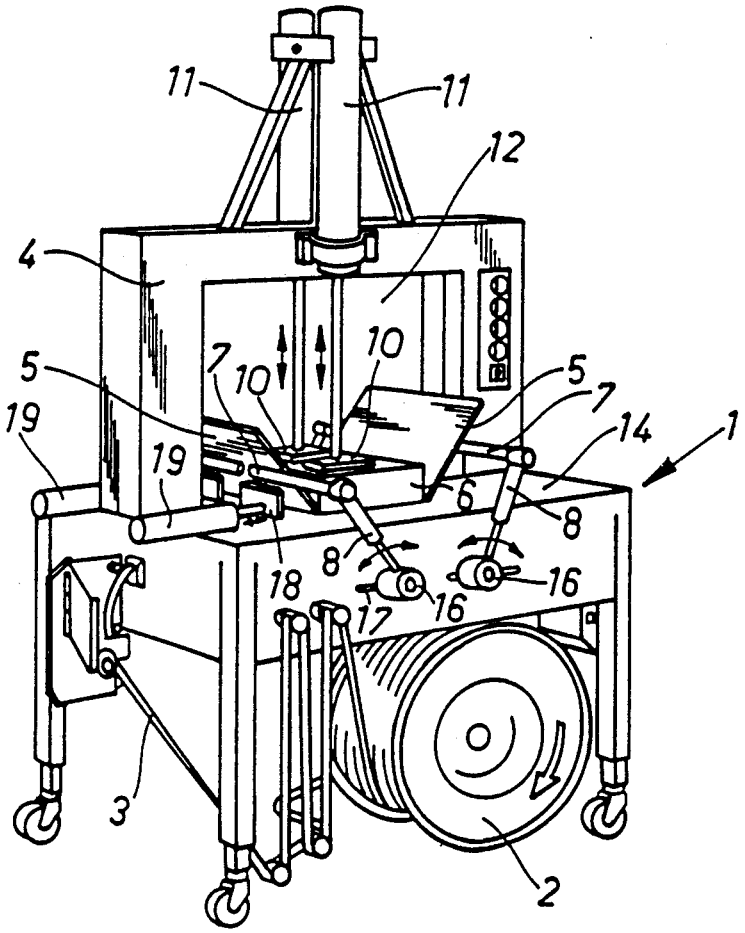
FIG. 4 is a perspective view of an apparatus according to a second embodiment of the invention.

As shown in FIG. 4, the apparatus can also be constructed in a manner such that the folding plane of the cardboard 5 is parallel to the plane of the strapping frame 4, whereby the horizontal movement component of folding means 7 is also parallel to the plane of strapping frame 4.

In the case shown in FIG. 4, the corresponding elements are provided with the same reference numbers as in FIGS. 1 and 2. The folding means 7 terminate at the plane of the strapping and are at their outer ends secured to a swinging arm 8 which is connected to a reversible motor 16. During the swinging motion said reversible motors can slide e.g. against a spring force along horizontal guide slots 17 to provide a preferred trajectory for the folding means 7. The guide slot 17 can also have an arcuate shape. The length of the swinging arms 8 can be telescopically adjustable for adapting the apparatus to bundles of books 6 of varying thickness.

The operation of this apparatus also proceeds in a manner such that press members 10 are first lowered on top of a bundle of books 6 followed by effecting the folding of cardboard 5 for swinging the ends of a cardboard sheet to vertical position. Thereafter the press members 10 are raised and the folding of cardboard 5 is completed and then the folding means 7 are returned and simultaneously the press members 10 are lowered as soon as there is enough space between folding means 7. The compression force of the press members 10 can be selected such as to be sufficiently low so that the winding of a band, which is now effected at the same plane as the folding of the cardboard 5, effects the tightening of the cardboard 5 around a book package 6. However, if it is preferred that the cardboard 5 be folded as tightly as possible around a book package 6 even prior to the winding of the band, the apparatus must be provided on top of a table 14 with pusher members 18 that can be pushed with a piston-cylinder unit 19 in a horizontal direction against the sides of a book package 6 at the same time as the folding means 7 continues turning the ends of cardboard 5 from vertical towards each other. FIG. 4 shows the pusher members 18 only on one side but a similar pair of pusher members must be mounted as well on the opposite side of strapping frame 4. Pusher members 18 press the opposite sides of a package while the press members 10 compress the top surface of a package until a band has been wound around such package. Also in this case the package can be turned through 90° and a crosswise band can be strapped for making sure that the package is truly enclosed Supplying the packaging blanks into the apparatus can be effected manually or automatically by means of a conveyor.

Timing of the operation of the folding means 7 and press members 10 as well as possible pusher members 18 can be combined with timing the wrapping action of a band 3 in a strapping machine 1 in such a manner that all actions are effected by means of a single external control command. If the supply of packages into the apparatus is effected manually, the control of package wrapping action can be separated from band strapping action, whereby the operator can visually determine that the package wrapping action is successfully completed before the band strapping operation is commenced.

What is claimed is:

1. An apparatus for wrapping and closing a package around a book, said apparatus having a base to support the material to be wrapped about the book, a holding element movable to seat against the book for holding it firmly against the wrapping material, said holding element having a pair of press members, means mounting said press members spaced apart from each other sufficiently to permit a strapping tape to be passed between them, a pair of folding means one on each of opposite sides of the book and each having a portion underlying the wrapping material, actuator means connected to said folding means to move said portions upwardly and inwardly to fold the ends of said material against the opposite edges of the book and then into overlapping relationship over the top of the book, actuator means for withdrawing said holding element after said portions have urged said wrapping against the opposite edges of the book and to move said holding element again into engagement with the overlapped ends of the wrapping material to hold it firmly ready for strapping.

2. An apparatus for wrapping and closing a package around a book as described in claim 1 wherein said portions of said folding means underlying the wrapping material each have a gap intermediate its ends, strapping tape applicator means for encircling the folded wrapping with a strapping band passing through said gap.

3. An apparatus for wrapping and closing a package around a book as described in claim 2 wherein said gap is centered between the ends of each of said folding means.

4. An apparatus for wrapping and closing a package around a book as described in claim 1 wherein clamp means are provided on opposite sides of the book, said clamp means being movable to press the wrapping material against opposite side edges of the book as said folding means fold the wrapping material into a position generally parallel to the sides of the book, said clamp means having a gap at its center to provide a path for the strapping tape.

* * * * *